US006599081B1

(12) United States Patent
Blidung et al.

(10) Patent No.: US 6,599,081 B1
(45) Date of Patent: Jul. 29, 2003

(54) METHOD OF AND APPARATUS FOR SUPPLYING BLANKS TO A PACKING MACHINE

(75) Inventors: Otto Blidung, Geesthacht (DE); Walter Kitzing, Pinneberg (DE); Karl-Heinz Klingebiel, Handorf (DE)

(73) Assignee: Hauni Maschinenbau AG, Hamburg (DE)

( * ) Notice: Subject to any disclaimer, the term of this patent is extended or adjusted under 35 U.S.C. 154(b) by 0 days.

(21) Appl. No.: 09/498,839

(22) Filed: Feb. 4, 2000

(30) Foreign Application Priority Data

Feb. 4, 1999 (DE) ..... 199 04 443

(51) Int. Cl.[7] ..... B65G 60/00
(52) U.S. Cl. ..... 414/796.4; 414/788.7
(58) Field of Search ..... 414/788.7, 789.1, 414/794.2, 796.4

(56) References Cited

U.S. PATENT DOCUMENTS

| | | | | | |
|---|---|---|---|---|---|
| 4,927,321 | A | * | 5/1990 | Lucas | 414/794.2 X |
| 4,955,794 | A | * | 9/1990 | Fluck | 414/794.2 X |
| 5,051,058 | A | * | 9/1991 | Roth | 414/789.1 |
| 5,302,079 | A | | 4/1994 | Cestonaro et al. | |
| 5,340,263 | A | | 8/1994 | Neri et al. | |
| 5,476,361 | A | * | 12/1995 | Uno | 414/794.2 X |

FOREIGN PATENT DOCUMENTS

| | | | | |
|---|---|---|---|---|
| DE | 1 611 884 | | 3/1972 | |
| DE | 387 757 | | 8/1988 | |
| DE | 38 05 974 | A1 | 9/1989 | |
| DE | 42 10 812 | A1 | 10/1993 | |
| DE | 692 00 042 | T2 | 7/1994 | |
| DE | 196 35 433 | A1 | 3/1998 | |
| DE | 197 28 515 | A1 | 1/1999 | |
| EP | 0 454 206 | A2 | 10/1991 | |
| EP | 0 729 888 | A1 | 9/1996 | |
| JP | 55-119656 | * | 9/1980 | 414/789.1 |
| JP | 56-61241 | * | 5/1981 | 414/789.1 |
| JP | 60-99441 | * | 6/1985 | 414/789.1 |

* cited by examiner

*Primary Examiner*—Janice L. Krizek
(74) *Attorney, Agent, or Firm*—Venable LLP; Robert Kinberg; Chad C. Anderson

(57) ABSTRACT

Successive collapsed cardboard blanks which can be erected to accommodate, for example, arrays of cigarette cartons are supplied from a source (such as a magazine for one or more piles of superimposed randomly distributed properly oriented and misoriented blanks) to a packing machine along a path wherein the orientations of successive blanks are monitored and the misoriented blanks are reoriented so that the packing machine receives blanks each of which is in an optimum orientation for erection and subsequent reception of arrays of commodities. The arrangement for monitoring and, if necessary, correcting the orientation of successive blanks can include pneumatic and/or other conveyors, mobile props, mobile pushers, an upright chute and a vertically movable supporting platform for stacks of monitored and (if necessary) reoriented blanks. One of the conveyors can serve to accumulate at least one pile of superimposed properly oriented (including reoriented) blanks prior to introduction of such blanks into the packing machine.

27 Claims, 9 Drawing Sheets

METHOD OF AND APPARATUS FOR SUPPLYING BLANKS TO A PACKING MACHINE

CROSS-REFERENCE TO RELATED APPLICATION

This application claims the priority of German patent application Ser. No. 199 04 443.0 filed Feb. 4, 1999. The disclosure of the above-referenced German patent application, as well as that of each US and foreign patent and patent application mentioned in the specification of the present application, is incorporated herein by reference.

BACKGROUND OF THE INVENTION

The present invention relates to improvements in methods of and in apparatus for supplying blanks to a packing machine, e.g., a machine wherein the blanks are converted into containers for separately produced and/or assembled commodities and wherein the filled containers are or can be sealed prior to transport to storage or directly to the consumers.

It is customary or necessary to produce blanks (e.g., cardboard blanks which can be converted into boxes of any desired size and/or shape) at a location remote from the machine or machines wherein the boxes are filled with certain types of commodities, e.g., with cigarette packs or with so-called cartons containing arrays of cigarette packs. It is advisable to collapse preassembled boxes into flat blanks having two or more overlapping panels to thus simplify the transport of collapsed boxes from the maker of boxes to the consuming or processing (e.g., a packing) machine. As a rule, the processing machine is provided with a magazine for continuously or intermittently supplied collapsed blanks as well, as with suitable means for removing collapsed blanks from the magazine, for erecting or expanding the removed blanks, and for filling the thus obtained empty containers with arrays of commodities.

A method of and an apparatus for supplying blanks in the form of collapsed boxes are disclosed, for example, in published German patent application Serial No. 38 05 974 A 1. The apparatus which is described in the German publication employs a pallet which receives a stack of superimposed flat or substantially flat horizontal blanks from a maker of blanks and cooperates with a tilting conveyor serving to lift successive topmost blanks off the stack and being set up to move the thus removed blanks from a horizontal plane into an at least substantially vertical plane. The thus tilted or pivoted blanks are introduced into the magazine of the packing machine.

Published German patent application Serial No. 42 10 812A 1 discloses a box filling machine which employs a transfer unit serving to lift successive topmost horizontal blanks off a stack of such blanks on a pallet and to introduce the thus lifted horizontal blanks directly into that unit of the packing machine which is designed to convert a blank in the form of a collapsed box into an erected or expanded box ready to receive an array of commodities, e.g., cartons containing predetermined numbers of cigarette packets. The transfer unit of the just described apparatus employs (or can employ) a suction-operated blank lifting and advancing conveyor.

A drawback of presently known methods and apparatus of the above outlined character is that a substantial number of blanks which reach the packing machine enter the machine in an orientation which departs from an optimum or predetermined orientation. This can create numerous problems such as the conversion or erection of misoriented collapsed blanks into unsatisfactory receptacles incapable of receiving predetermined arrays of cigarette packs or other commodities. Moreover, a misoriented blank is apt to come to a halt in a position in which it blocks the path for advancement of next-following (properly oriented) blanks. This can necessitate a temporary slowdown or full stoppage of an entire production line, e.g., a production line employing a plain cigarette maker, a filter rod making machine, a filter tipping machine, a carton filling machine, a carton wrapping machine, and a boxing machine wherein groups of wrapped cartons are to be introduced into erected blanks such as cardboard boxes.

OBJECTS OF THE INVENTION

An object of the invention is to provide an apparatus which ensures that a machine for introducing commodities into boxes constituting prefabricated and subsequently expanded or erected blanks invariably receives blanks the orientation of which at least approximates an ideal or optimum orientation.

Another object of the invention is to reduce the number of rejects in a production line employing one or more packing machines designed to introduce arrays of commodities into boxes or analogous receptacles constituting converted blanks of cardboard or the like.

A further object of the invention is to provide the apparatus with novel and improved means for manipulating properly oriented as well as misoriented blanks in a path between a maker of blanks and a packing machine serving to convert the blanks into receptacles and to fill the thus obtained receptacles.

An additional object of the invention is to provide novel and improved means for transporting blanks which constitute collapsed boxes or analogous receptacles.

Still another object of the invention is to provide the improved apparatus with means for building stacks, piles or analogous accumulations of properly oriented blanks made of cardboard or the like.

A further object of the invention is to provide a method of correcting the orientation of misoriented blanks and/or of preventing misorientation of blanks which are being supplied to a packing machine.

Another object of the invention is to provide a novel and improved method of supplying to a consumer short or long series of successive blanks in such a way that each blank which reaches the consumer is compelled to assume a desired orientation or to maintain such orientation at the locus of entry into the consumer.

An additional object of the invention is to provide a method which renders it possible to position the maker of blanks at any desired practical distance from the user of blanks, e.g., in a plant wherein rod-shaped smokers products are packed, the packets cartoned, and the cartons boxed for storage and/or for transport to consumers.

Still another object of the invention is to provide a method which renders it possible to treat gently collapsed cardboard boxes on their way from a maker or another source of blanks and all the way to the station where the blanks are put to use.

A further object of the invention is to provide a novel and improved method of accumulating stacks of superimposed blanks wherein each and every blank is in a position of full overlap with the neighboring blank or blanks.

Another object of the invention is to provide a novel and improved apparatus for the practice of the above outlined method.

An additional object of the invention is to provide an apparatus which can be installed in existing production lines for the making, testing, assembling and packing products of the tobacco processing industry.

SUMMARY OF THE INVENTION

One feature of the present invention resides in the provision of a method of supplying blanks to a packing machine (e.g., to a machine known as CP 90 case packer and distributed by the assignee of the present application) in a predetermined orientation. The method comprises the steps of establishing a path for the transport of blanks from a source (such source can comprise one or more stacks or piles of superimposed blanks) to the packing machine, advancing the blanks from the source to the packing machine along the path, and changing the orientation of the blanks when such orientation of blanks in the path departs from the predetermined orientation.

The blanks can constitute at least substantially flat collapsed bodies (e.g., collapsed boxes made of a material having or resembling the characteristics of cardboard). As already mentioned hereinbefore, such collapsible boxes can be utilized to receive and confine so-called cartons each of which contains an array of cigarette packets of the type known as soft or hinged-lid packets). For example, each box can be dimensioned to receive five neighboring stacks of five cartons each, and each carton can contain two layers of five cigarette packets each.

The advancing step can comprise conveying successive blanks of a series of discrete blanks, and the orientation changing step can comprise individually reorienting discrete blanks having orientations departing from the predetermined orientation.

The advancing step can also comprise temporarily arresting the blanks in a predetermined portion of the path; in accordance with such method, at least a portion of the orientation changing step can be carried out in the predetermined portion of the path. The advancing step of such method can include conveying successive blanks of a series of successive blanks from the source into the predetermined portion of the path wherein the blanks are caused to dwell until after completion of a portion of or the entire orientation changing step, and the advancing step can further include conveying blanks from the predetermined portion of the path to the packing machine upon completion of the orientation changing step. Such method can further comprise the step of temporarily stacking blanks in the predetermined portion of the path. The stacking step can precede, take place simultaneously with or follow the orientation changing step. The orientation of each temporarily stacked blank can already match the predetermined orientation. That portion of the advancing step which includes conveying blanks from the predetermined portion of the path to the packing machine preferably includes preventing changes of orientation of blanks between the predetermined portion of the path and the packing machine.

The method can further comprise the step of monitoring the orientation of each blank furnished by the source, and the orientation changing step of such method can include changing the orientation of each blank the monitoring of which has resulted in a detection of orientation departing from the predetermined orientation. The monitoring step can form part of or can be carried out simultaneously with the orientation changing step.

The orientation changing step can include imparting to the blanks motion by way of their marginal portions.

If the blanks are elongated (or even square), i.e., if each blank has a longitudinal extension (i.e., length) and a transverse extension (i.e., width), the orientation changing step can include moving those blanks whose orientations depart from the predetermined orientation in the direction of the longitudinal and/or transverse extension of the misoriented blank. Alternatively, the orientation changing step can include moving the blanks having orientations departing from the predetermined orientation transversely of the longitudinal extension and/or transverse extension.

Still further, the orientation changing step can include causing at least the misoriented blanks to descend by gravity (e.g., in a vertical chute) with attendant changes of orientation.

The orientation changing step can be followed by a step of stacking the blanks on a support (such as a vertically movable platform) defining a preselected portion of the path. The orientation changing step of such method can include interrupting the advancement of successive blanks of a series of blanks supplied by the source at a level above the support, shifting at such level those (misoriented) blanks the orientation of which departs from the predetermined orientation, and thereupon effecting a gravitational descent of blanks from the aforementioned level onto the support. Such orientation changing step can further include maintaining successive blanks of the series at the aforementioned level in a horizontal plane in the course of the shifting step and prior to gravitational descent of successive blanks.

The advancing step can include changing the inclination of blanks from an at least substantially vertical plane into an at least substantially horizontal plane or vice versa.

As already mentioned hereinbefore, the source can be constituted by at least one pile of superimposed blanks including blanks having and blanks departing from the predetermined orientation.

Another feature of the present invention resides in the provision of an apparatus for supplying blanks from a source to a packing machine in a predetermined orientation. The improved apparatus comprises essentially means for advancing blanks from the source to the packing machine along a predetermined path, and means for changing the orientation of blanks when the orientation of blanks in the predetermined path departs from the predetermined orientation. The blanks are or they can constitute at least substantially collapsed flat (actually flattened multi-layer) bodies of a material constituting or resembling cardboard.

The source can contain or consist of at least one accumulation (such as a stack or a pile) of blanks, and the advancing means can comprise (singularizing) means for converting the accumulation of blanks into a series (such as a file) of successive blanks.

The advancing means can comprise means for temporarily arresting the blanks in a predetermined portion of the predetermined path, and the orientation changing means of such apparatus is or can be arranged to change the orientation of blanks in the predetermined portion of such path. The advancing means of such apparatus can further comprise means for the stacking arrested blanks in the predetermined portion of the path, and the apparatus can further comprise means for preventing or for reducing the likelihood of changes of orientation of blanks between the predetermined portion of the path and the packing machine.

The orientation changing means can comprise means for imparting motion at least to the marginal portions of those (misoriented) blanks the orientation of which departs from the predetermined orientation. Such motion transmitting means can include means for moving the misoriented blanks lengthwise and/or widthwise, i.e., in the direction of their longitudinal and/or transverse extension or extensions. The motion imparting means can include pushers for marginal portions of the blanks.

In many instances, the marginal portions of the blanks are provided with corners having mutually inclined edge faces, and the motion imparting means of the orientation changing means in an apparatus for manipulating such types of blanks can include pushers for the edge faces of corners of at least those (misoriented) blanks in a predetermined portion of the path the orientation of which departs from the predetermined orientation. Such pushers can include substantially V-shabed blank-engaging portions.

The orientation changing means can include means for shifting misoriented blanks lengthwise and/or widthwise (i.e., transversely of at least one of their longitudinal and or transverse extensions). Such shifting or guide means is installed in or at a predetermined portion of the path and can include a plurality of stationary elongated guide members arranged to engage mutually inclined marginal portions of blanks in the predetermined portion of the path. The guide members are or can be at least substantially parallel to each other. For example, the guide members can include at least substantially vertical portions defining a chute for blanks in the predetermined portion of the path. Such orientation changing means can further include the aforementioned support (e.g., a platform) which is arranged to intercept successive blanks which descend in the chute and to thus accumulate a stack of superimposed blanks having orientations matching the predetermined orientation. Still further, such orientation changing means can comprise means for moving the support in the duct between an upper level and a lower level, and pushers for marginal portions of the blanks; the pushers can be installed in the predetermined portion of the path at the upper level of the support. Such orientation changing means can also comprise props which are arranged to temporarily support, at a level above the chute, successive blanks of a series of blanks being advanced from the source to the predetermined portion of the path. Still further, such orientation changing means can be equipped with means for shifting the props between extended positions in which the props intercept and thus prevent gravitational descent of a blank in the chute, and retracted positions in which the intercepted blank is free to descend in the chute under the action of gravity until the descending blank is intercepted by the support. The props can include a pair of ledges which confront each other across the chute and are movable toward each other to their extended positions and away from each other to their retracted positions.

The improved apparatus can further comprise a magazine or reservoir or other suitable means for temporarily accumulating piles of properly oriented and reoriented blanks in a second portion of the path between the predetermined portion and the packing machine.

The advancing means can comprise at least one pneumatic conveyor means for discrete blanks or another suitable conveyor which can lift successive blanks off a pile of randomly distributed properly oriented and misoriented blanks and thereupon transports the lifted blanks into the range of the orientation changing means.

If the source comprises one or more supplies of collapsed blanks which can be expanded to constitute boxes or the like, the packing machine can comprise means for expanding the collapsed blanks and for introducing arrays of block-shaped commodities into the expanded blanks.

In many instances, the orientation changing means can be designed and installed in such a way that it comprises means for manipulating successive blanks in a plurality of different portions of the path extending from the source to the packing machine.

The different portions of the path can include at least one substantially horizontal and at least one at least substantially vertical portion.

The novel features which are considered as characteristic of the invention are set forth in particular in the appended claims. The improved apparatus itself, however, both as to its construction and the various modes of assembling and operating the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
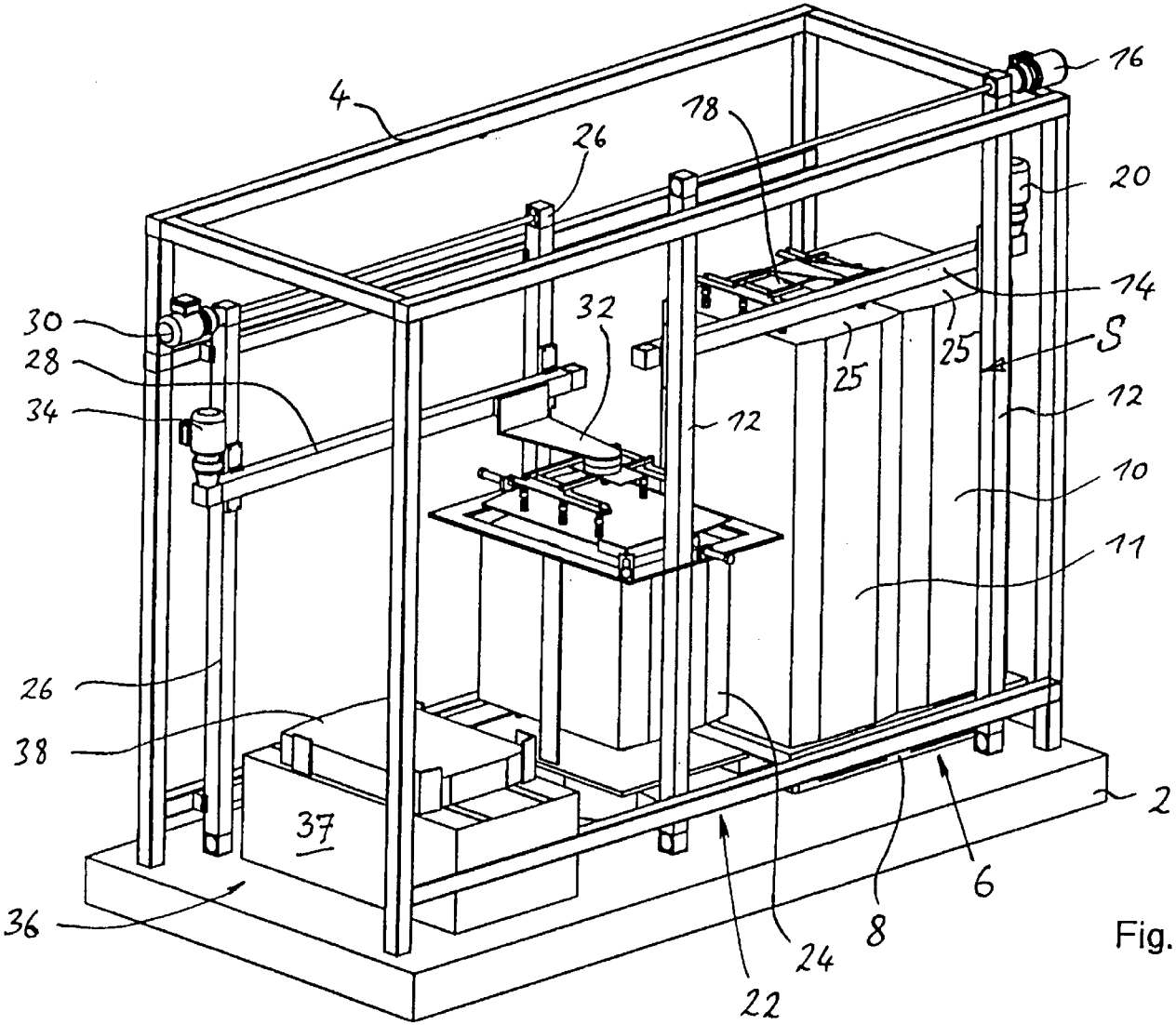
FIG. 1 is a perspective view of an apparatus which embodies one form of the present invention and wherein the source of collapsed blanks includes two piles of superimposed properly oriented and misoriented blanks.
Figure 2:
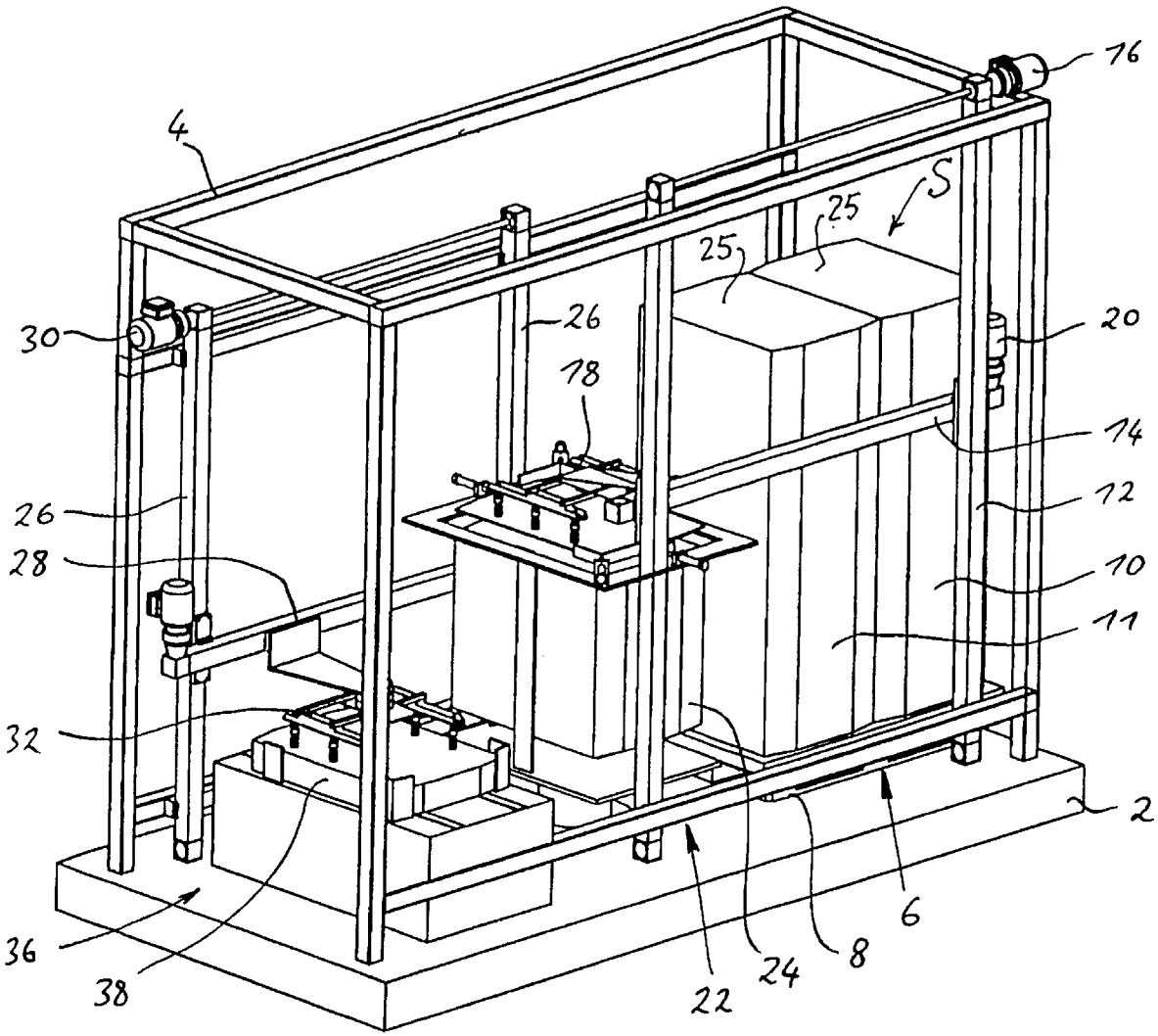
FIG. 2 shows the structure of FIG. 1 but with certain part,s of the blank advancing means in different positions.

The apparatus which is shown in FIGS. 1 and 2 is designed to supply blanks 25 from a source S to a packing machine PM (see FIG. 3) or to another blank processing (such as expanding or erecting and filling) machine. Each blank 25 is, a collapsed (multiple-layer) receptacle or box of corrugated board or any other suitable relatively stiff board which is normally provided with creases or fold lines so that it can be expanded or erected into a receptacle having a predictable size and shape and designed to receive a supply of randomly distributed commodities or an array of commodities having a predetermined size and shape. As already mentioned hereinbefore, the packing machine PM can constitute a so-called CP 90 case packer which is designed to receive collapsed blanks, to erect such blanks into boxes, to introduce into each erected box an array of (e.g., twenty-five) so-called cartons each of which can contain two layers of five cigarette packets or packs each, and to close and preferably seal each filled box (e.g., by resorting to strips of adhesive-coated tape). The CP 90 case packer can receive cartons from a so-called Pewo-Fold overwrapper wherein cardboard cartons are confined in transparent envelopes or directly from a so-called G 90 parceller serving to make and wrap cartons containing so-called soft or so-called hinged lid cigarette packets or packs. Not only the CP 90 case packer but also the other aforementioned machines (namely the Pewo-Fold overwrapper and the G 90 parceller) are distributed by the assignee of the present application.

The exact mode of making the blanks 25 forms no part of the present invention. The conversion of panels of corrugated board or other suitable box making material into collapsed blanks 25 can involve treatment in a stamping machine, in a folding or creasing machine, in a machine for folding certain flaps, walls and tucks of the thus obtained single-layer blank over each other, and in a machine which secures (e.g., glues) certain overlapping parts of the thus obtained collapsed box to each other.

The apparatus of FIGS. 1 and 2 comprises a plate-like base 2 and a frame 4 supported by the base 2 and assembled of elongated profiled members of steel or other suitable material. A first portion 6 of the frame 4 confines the aforementioned source S which, in the apparatus of FIGS. 1 and 2, comprises two upright piles 10 and 11 of superimposed blanks 25. The piles 10, 11 rest on a pallet 8 which, in turn, rests on the base 2. Loaded pallets 8 can be delivered into the frame portion 6 by a suitable vehicle (such as a fork lift, not shown), and such vehicle or one or more additional vehicles can serve to remove the empty pallet and to deliver a pallet which contains a fresh supply S of piles 10 and 11.

It is clear that each pallet 8 can carry a single pile (10 or 11 ) of collapsed blanks 25, or more than two piles. Each such pile contains a substantial number of superimposed overlapping blanks in proper (predetermined) orientation ready to be introduced into the magazine of the packing machine PM; however, it can happen again and again that a pile 11 and/or 10 contains one or more misoriented blanks 25, and an important advantage of the improved apparatus is that it can detect and correct the orientation of misoriented blanks before such blanks enter the packing machine PM.

The frame 4 comprises two spaced-apart vertical rails 12 which support a vertically movable horizontal rail 14 extending longitudinally of the frame 4. The means for moving the rail 14 up and down along the vertical rails 12 comprises a suitable prime mover 16 (e.g., a reversible electric motor) which is mounted at the top of the frame 4. The horizontal rail 14 movably supports a pneumatic conveyor 18 forming part of the means for advancing blanks 25 from the pile 11 or 10 along a predetermined path within the frame 4, and on to the packing machine PM. The means for moving the conveyor 18 longitudinally of the vertically movable horizontal rail 14 comprises a prime mover (e.g., a reversible electric motor) 20 which shares the movements of the rail 14 along the guide rails 12.

The pneumatic conveyor 18 has one or more downwardly extending suction cups (not shown) which are connectable to a, suction generating device (such as the air intake of a fan) to attract the topmost blank 25 of the pile 11 or 10 prior to lifting of the rail 14 (and hence of the conveyor 18) by the motor 16; such lifting is followed by movement of the conveyor 18 along the rail 14 in a direction from the first portion 6 into a second portion 22 of the frame 4. The rail 14 is thereupon lowered with the conveyor 18 so that the latter deposits the single collapsed blank 25 on a constituent 44 (see FIG. 3) of the orientation monitoring or detecting and (if necessary) altering means forming part of the improved apparatus.

The blanks 25 which are transferred from the pile 11 or 10 into the range of the orientation detecting and altering means in the frame portion 22 are ultimately assembled into a stack 24 of superimposed horizontal properly oriented blanks which rest on a vertically movable platform or support 42 (see FIGS. 3 to 7) prior to being transferred or advanced toward or directly into the magazine of the packing machine PM.

The frame 4 comprises two additional upright guide rails 26 vertically movably supporting an elongated horizontal rail 28 extending longitudinally of the frame in a third frame portion located between the median portion 22 and the packing machine PM. The rail 28 is movable up and down along the guide rails 26 by a prime mover 30 (e.g., a reversible electric motor). A pneumatic conveyor 32 is supported by and is movable along the horizontal rail 28 by a prime mover 34 (e.g., a reversible electric motor). The motor 30 is mounted in or on the top portion of the frame 4, and the motor 34 shares the vertical movements of the rail 28. The conveyor 32 forms part of the aforementioned means for advancing blanks 25 from the source S to the packing machine PM and can include one or more downwardly extending suction cups (not shown) connectable to a suction generating device (such as the aforementioned suction fan for the conveyor 18, or a discrete suction fan) when the conveyor 32 is called upon to lift successive upper-most (properly oriented) blanks 25 off the stack 46 and to deliver the thus lifted blanks to the packing machine PM or to a station 36 which serves for temporary accumulation of stacks or piles 38 of properly oriented blanks prior to introduction into the magazine of the packing machine. The motor 30 is used to move the rail 28 and the second conveyor 32 up and down along the guide rails 26, and the motor 34 is utilized to move the conveyor 32 longitudinally of the horizontal rail 28 between a first end position at a level above the platform or support 42 and a second end position above the station 36.

The magazine for the stack or pile 38 at the station 36 can form part of the improved apparatus or it can constitute the magazine of the packing machine PM. The means for lifting successive uppermost (properly oriented) blanks 25 at the top of the pile or stack 38 and for introducing the thus lifted blanks into a selected portion of the packing machine PM (e.g., to a blank erecting or expanding station, not shown) can include a further conveyor, not shown. Alternatively, such function can be performed by the conveyor 32 or by a third conveyor the operation of which is or can be synchronized with that of the conveyor 32. It is presently preferred to design the station 36 in such a way that its magazine can assemble a relatively small pile or stack 38 of properly oriented blanks 25. Many presently utilized packing machines which can employ collapsed blanks 25 or analogous blanks are designed in such a way that a collapsed blank which is delivered thereto from a source is tilted or otherwise manipulated to move it from an at least substantially horizontal plane into an at least substantially vertical plane, and the thus manipulated blank is thereupon erected or expanded preparatory to receipt of selected commodities.

The means for initiating and otherwise controlling the operations of the motors 16, 20 for the conveyor 18 is preferably set up to operate in synchronism with the means for initiating and otherwise controlling the operations of the motors 30, 34 to avoid collisions between the properly oriented or misoriented blanks 25 being transported by the conveyor 18 from the pile 11 or 10 into the median portion 22 of the frame 4 and the properly oriented blanks 25 being transported by the conveyor 32 from the stack 24 to the station 36. FIG. 1 shows the conveyor 18 at a level above the pile 11 in the supply S, and the conveyor 32 at a level above the platform or support 42 (not shown), i.e., at a level above the stack 24 of properly oriented blanks in a chute CH in the median portion 22 of the frame 4. The control unit which synchronizes the movements of the conveyors 18 and 32 can be set up in such a way that the transfer of a blank 25 from the pile 11 or 12 into the median portion 22 of the frame 4 takes place simultaneously with transfer of a blank 26 from the stack 24 in the chute CH toward the pile 38 at the station 36. The same control unit can further serve to ensure that the conveyor 18 lowers a blank 25 onto the support or platform 42 or onto the growing stack 24 on the platform 42 simultaneously with lowering of a properly oriented blank 25 (by the conveyor 32) onto the block 37 at the station 36 or onto the growing pile or stack 38 on the block 37. FIG. 2 shows the conveyor 18 in its lower end position in the median portion 22 of the frame 4, and the conveyor 32 in its lower end position above the pile or stack 38.

Figure 3:
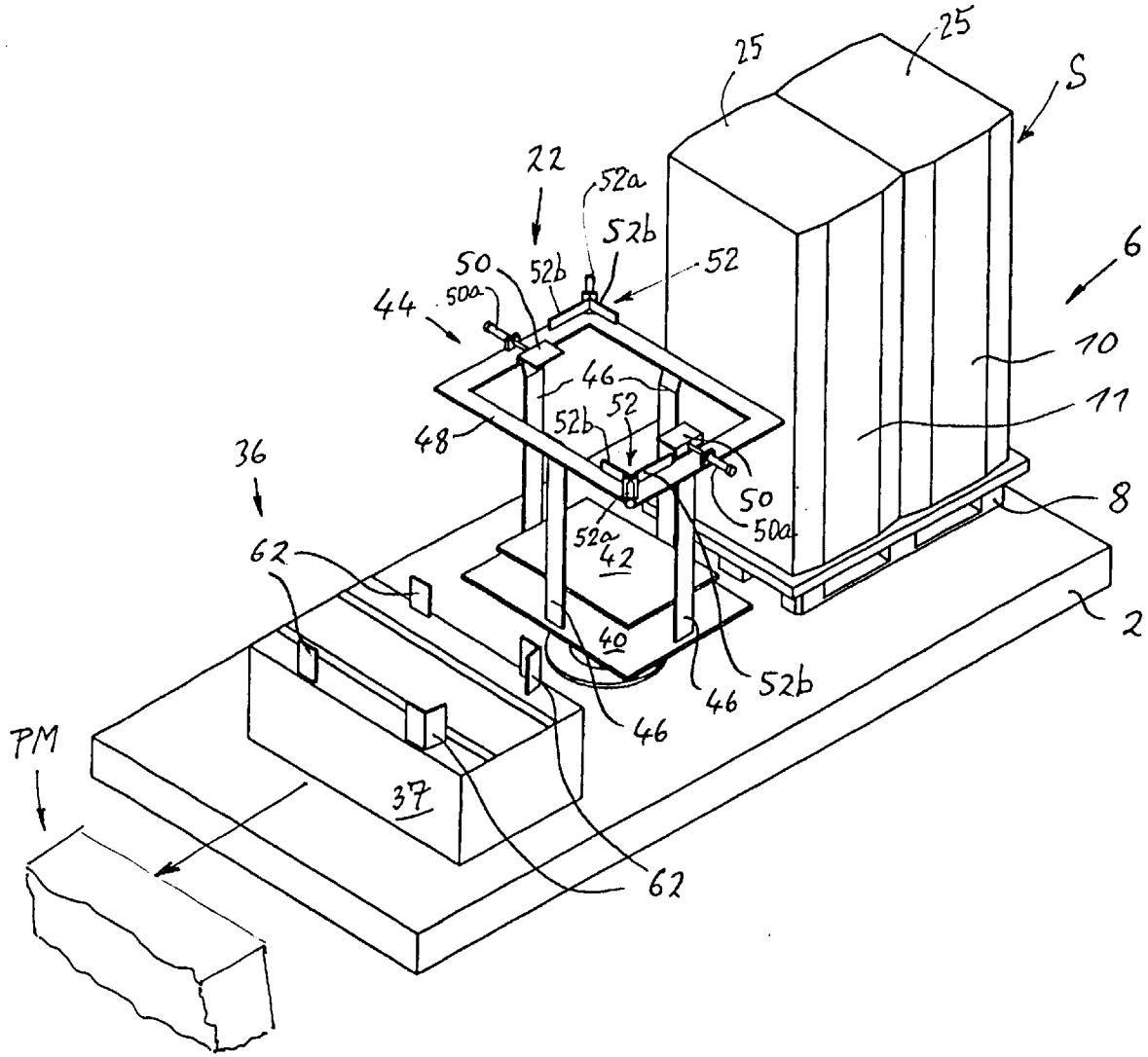
FIG. 3 is an enlarged perspective view of a portion of the apparatus shown in FIGS. 1 and 2, and further showing a portion of a packing machine for the reception and processing of properly oriented blanks including reoriented blanks.
Figure 4:
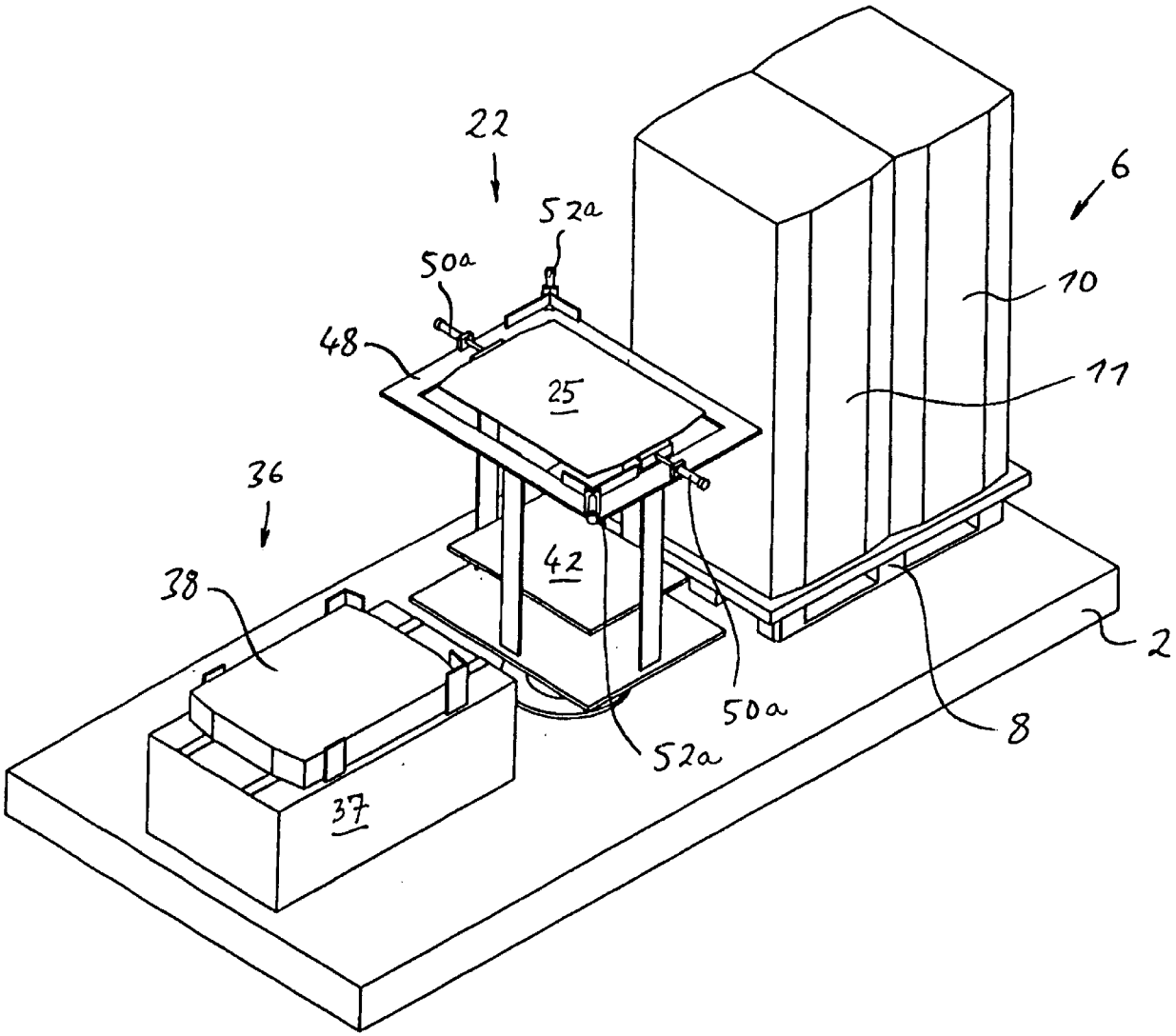
FIG. 4 shows the structure of FIG. 3 but with a blank in a position it assumes at the outset of an orientation ascertaining and, if necessary, correcting step.

FIGS. 3 and 4 illustrate certain parts of the orientation; monitoring and (if necessary) correcting or adjusting means in the path between the source S and the station 36 above the base 2 of the improved apparatus. The intermediate portion 22 of the frame 4 (not shown in FIGS. 3 to 9) provides room for a horizontal plate like carrier 40 for several upright guide members 46 defining the aforementioned chute CH for the stack 24 on top of the vertically movable support or platform (hereinafter called platform) 42. This platform is movable between a lower level. (shown in FIG. 3)and an upper level (assumed in FIG. 7).

The aforementioned constituent 44 includes the means for monitoring or ascertaining, and (if necessary) changing the orientation of certain blanks 25 of that series of discrete blanks which are being advanced by the conveyor 18 from the pile 10 or 11 at the source S into the median portion 22 of the frame 4. The upper end portions of the aforementioned stationary upright guide members 46 carry a rectangular frame 48 which can be welded, bolted or otherwise permanently or separably affixed to the guide members and serves to support a pair of horizontally reciprocable ledges or props 50 as well as two horizontally reciprocable pushers 52. The number of props 50 and/or pushers 52 can be increased without departing from the spirit of the invention.

The upper sides of the props 50 are plane and horizontal and the props confront each other across the chute (actually a vertical passage) CH. The apparatus further comprises means (such as hydraulically, or pneumatically operated cylinder and piston units) which can be actuated to move the two props relative to the frame 48, i.e., toward or away from each other. FIGS. 3 to 9 merely show the piston rods 50*a* of such cylinder and piston units. When the props 50 are moved to their extended positions (i.e., toward each other to the positions shown in FIG. 5), their plane surfaces extend radially inwardly beyond the frame 48 so that they can support the adjacent parts of the marginal portion 25*a* of a blank 25 which has been delivered and released by the conveyor 18. The illustrated frame 48 is a rectangular frame because the blanks 25 which are shown in the drawings have substantially rectangular shapes.

Each blank 25 has four corners 25*b*, and the pushers 52 which are shown in FIGS. 3 to 9 are adjacent to and adapted to engage and (if necessary) displace two corners 25*b* of a blank 25 the marginal portion 25*a* of which rests on the extended props 50. More specifically, the illustrated pushers 52 are adjacent two corners 25*b* which are located diametrically opposite each other. As can be best seen in FIGS. 5 to 9, each pusher 52 has two mutually inclined walls 52*b* which engage the adjacent edge faces of the respective corner 25*b* when the pushers 52 are moved toward each other while a properly oriented or a misoriented blank 25 rests on the plane surfaces of the props 50. The means for moving the pushers 52 between the retracted positions (see FIG. 5) and the extended positions (see FIG. 6) of engagement with the edge portions of the adjacent corners 25*b* can comprise fluid-operated (pneumatic or hydraulic) double-acting cylinder and piston units analogous to those which are shown as being associated with the props 50. The drawings merely show the piston rods 52*a* of such cylinder and piston units. The paths for movement of the pushers 52 between their extended and retracted positions are horizontal and, when the pushers are caused to move from the retracted to the extended positions, the undersides of their walls 52*b* slide along or are immediately adjacent the upper sides of the adjacent portions of the frame 48. Each pusher 52 can be said to resemble or constitute a substantially V-shaped body. The walls 52*b* of each pusher 52 can make an angle of 90° or an obtuse angle so that they closely conform to the mutual inclination of the edge faces of the adjacent corners 25*b* of a properly oriented blank 25 having a marginal portion 25*a* surrounded by the frame 48 and overlying the plane surfaces of the props 50 in the extended positions of the props.

In addition to their orientation changing or correcting function, the pushers 52 also serve as a means for monitoring the orientation of successively supplied blanks 25. Thus, the arrangement is or can be such that the pushers 52 actually displace only those blanks 25 the orientation of which departs from an optimum orientation. Once a misoriented blank 25 has been reoriented, it is located in such position that it can descend by gravity into the chute CH as soon as the pushers 52 and the props 50 are retracted.

The means for moving the props 50 and/or the pushers 52 relative to each other can employ any suitable prime movers, e.g., electric motors, electromagnets or the like. It is further possible to mechanically link the two props 50 and/or the two pushers 52 with each other so that a single motor suffices to move the props 50 toward or away from each other and a single motor suffices to move the pushers 52 toward and away from each other. The just discussed motors or the illustrated cylinder and piston units can receive signals to move the respective parts 50, 52 of the orientation monitoring and adjusting means from the aforementioned control unit for the motors 16, 20 and/or 30, 34

The block 37 at the station 36 is provided with upwardly extending plate-like and/or substantially V-shaped abutments 62 which are adjacent the marginal portions of properly oriented blanks 25 constituting the pile or stack 38 As already mentioned hereinbefore, the magazine including the block 37 at the station 36 can form part of the packing machine PM. In such instances, and if the packing machine is designed to open up or erect collapsed blanks 25 subsequent to a change of orientation of each properly oriented blank (supplied by the conveyor 32) in a horizontal plane, the block 37 is turnably mounted on the base 2 in such a way that it can assume a first angular position for reception of blanks 25 from the conveyor 32 and a second angular position for convenient manipulation of blanks by the erecting mechanism of the packing machine PM. This can be readily seen by comparing the angular positions of the block 37 shown in FIGS. 3 and 4.

Of course, the block 37 need not turn relative to the base 2 if the packing machine PM is set up to readily manipulate blanks 25 in positions they assume on a block 37 which is fixed to the base 2 or which normally assumes the angular position shown in FIG. 3 or 4. It is evident that the controls for movements of the conveyor 32 must be designed with a view to take into consideration that the improved apparatus employs a fixedly mounted block 37 or a block which can and must be repeatedly turned to assume the angular position of FIG. 3 or FIG. 4.

FIG. 3 shows certain parts of the improved apparatus in positions they assume when the apparatus is idle. The first portion 6 of the frame 4 accommodates a pallet 8 with two fresh piles 10, 11 of superimposed randomly distributed properly oriented and misoriented blanks 25. The vehicle (such as a fork lift) which is utilized to deliver loaded pallets 8 onto the base 2 and to remove empty pallets is not shown in the drawings. In fact, it is also possible that all of the blanks 25 in the piles 10 and 11 are misoriented, for example, because the vehicle failed to deposit the loaded pallet 8 in requisite position on the base 2, i.e., in the first portion 6 of the frame 4. Furthermore, it is also possible that a properly positioned pallet 8 supports a properly oriented pile 10 or 11 and an improperly oriented pile 11 or 10, or that a properly positioned pallet 8 supports two improperly positioned or oriented piles 10, 11. In many, or perhaps most, instances the pallet 8 is likely to be properly positioned on the base, the piles 10, 11 are likely to be properly positioned on the properly positioned pallet, but the pile 10 and/or the pile 11 contains a number of superimposed blanks 25 some of which are properly oriented but the others are misoriented.

Certain types of blanks are or must be provided with asymmetrical fold lines or seams; this renders it necessary to stack the oddly numbered blanks in each of the piles 10, 11 in a first orientation and to stack the evenly numbered blanks in each of these piles in a different second orientation, e.g., at a 180° angle to the first orientation. Such alternate orienting renders it possible to accumulate stable piles which are not likely to spill their blanks during stacking on a pallet 8 and/or during transport of a loaded pallet onto the base 2, even if the piles are relatively tall.

The first step of the method involves utilizing the first conveyor 18 (shown only in FIGS. 1 and 2) to transport the topmost blank 25 of the pile 10 or 11 from the first portion 6 into the second portion 22 of the frame 4. If the orientation of oddly numbered blanks 25 in the pile 10 and/or 11 departs from the orientation of evenly numbered blanks (e.g., by 180°), that (lower) portion of the conveyor 18 which actually engages and lifts the topmost blank 25 of the pile 10 or 11 is mounted on the upper portion of the conveyor 18 in such a way that it can be turned about a vertical axis in order to change the orientation of each oddly or each evenly numbered blank through a required angle subsequent to lifting of a blank and prior to deposition of turned blank on the frame 48 in the intermediate portion 22 of the frame 4.

Figure 5:
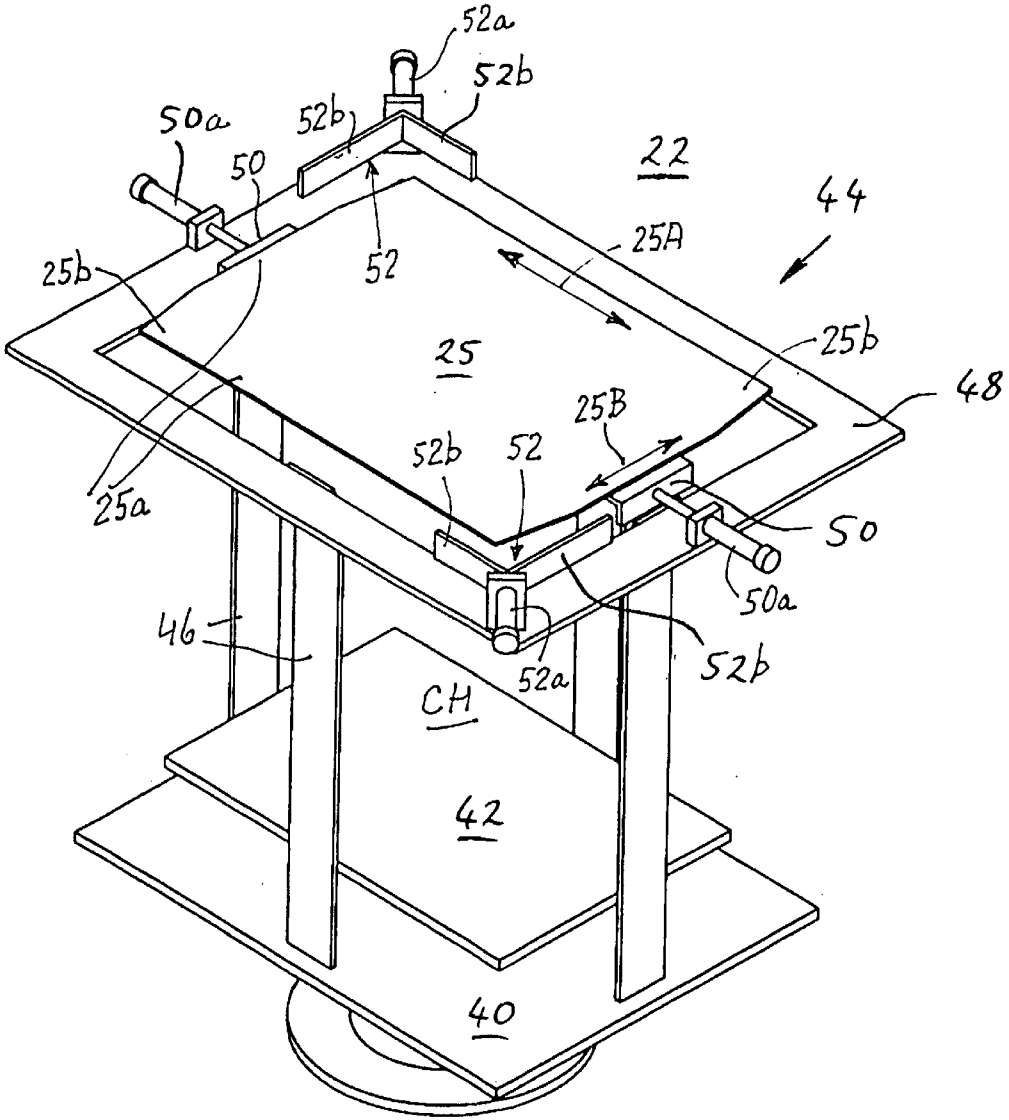
FIG. 5 is an enlarged view of a detail in the structure of FIG. 4, a blank being shown in a position resting on two ledges or prongs of the orientation ascertaining and correcting means.

When the conveyor 18 is in the process of descending toward the frame 48, the props 50 already assume their extended positions while the pushers 52 assume their retracted positions (see FIG. 3). This enables the conveyor 18 to deposit the marginal portions 25*a* of the blank 25 on the plane surfaces of the props 25 adjacent the upper side of the frame 48 but two of the corners 25*b* of such blank are merely adjacent to but still spaced apart from the walls 52*b* of the respective (retracted) pushers 52. The conveyor 18 can actually lower a blank 25 onto the props 50, or the apparatus is merely set up to ensure that the conveyor 18 can drop a blank 25 within the frame 48 when the conveyor 18 has advanced from the position of FIG. 1 to the position in FIG. 2, i.e., to a position exactly above the chute CH. Such position of a freshly deposited blank 25 is shown in FIGS. 4 and 5. Thus, the props 50 underlie the adjacent parts of the marginal portion 25*a* and the walls 52*b* of the pushers 52 are spaced apart from the neighboring corners 25*b* of the blank 25 above the frame 48 in the intermediate portion 22 of the frame 4.

Figure 6:
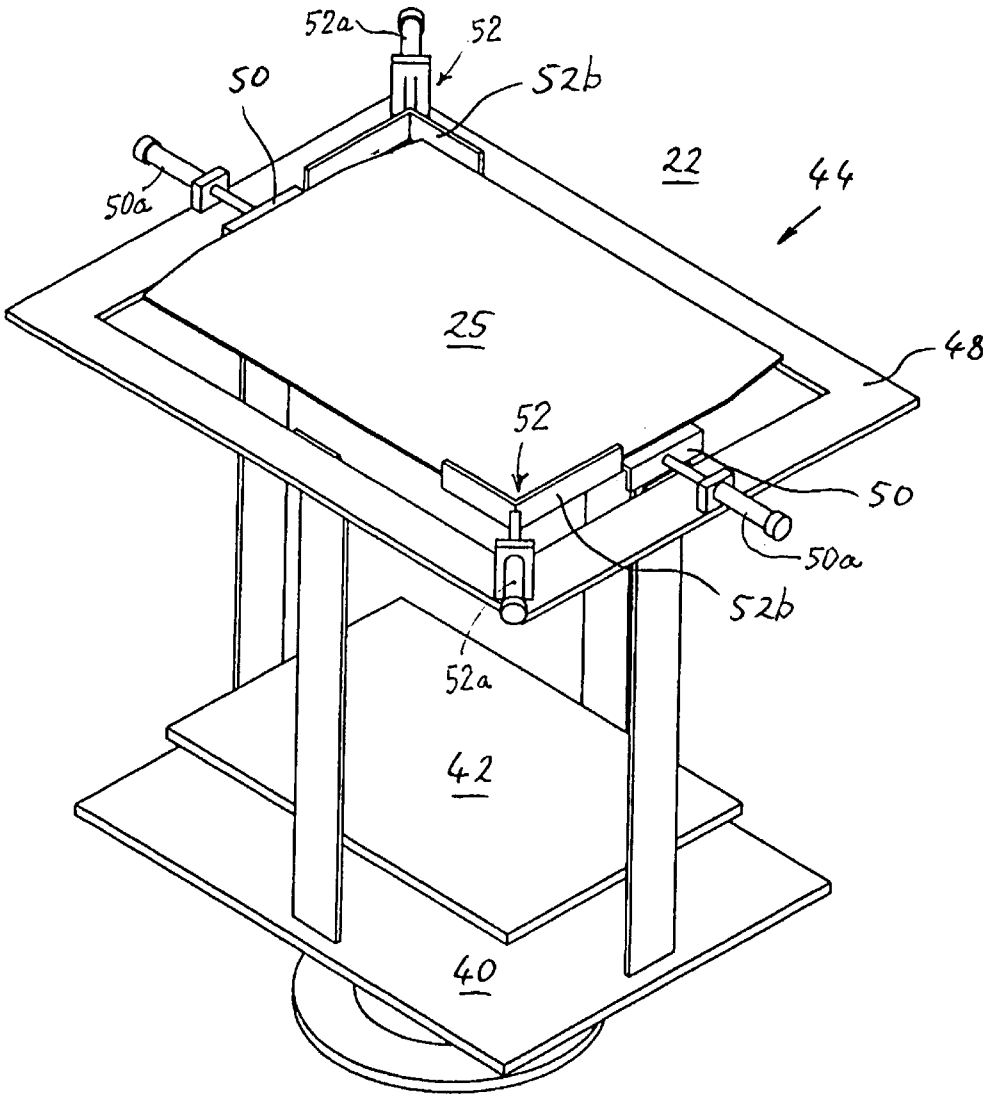
FIG. 6 shows the structure of FIG. 5 but with two corners of the blank engaged by V-shaped pushers of the orientation detecting and correcting means.

The control unit thereupon causes the motors including the piston rods 52*a* to move the two pushers 52 toward each other and to engage the mutually inclined edge faces of the adjoining corners 25*b*. Such extended positions of the pushers 52 are shown in FIG. 6. During movement from their retracted positions of FIG. 5 to the extended positions of FIG. 6, the walls 52*b* of the advancing pushers not only monitor but also simultaneously change the orientation of those blanks 25 above the frame 48 the orientation of which departs from the required or optimum orientation. A properly oriented blank 25 is located within the confines of the frame 48 of the illustrated apparatus so that such blank can descend into the chute CH as soon as the props 50 and the pushers 52 are returned to the retracted positions shown in FIG. 7. Thus, each of the blanks 25 entering into and descending in the chute CH has assumed or has remained in an orientation which is desired for subsequent manipulation of the growing stack 24 of blanks by the platform 42 and thereupon by the second conveyor 32.

Figure 7:
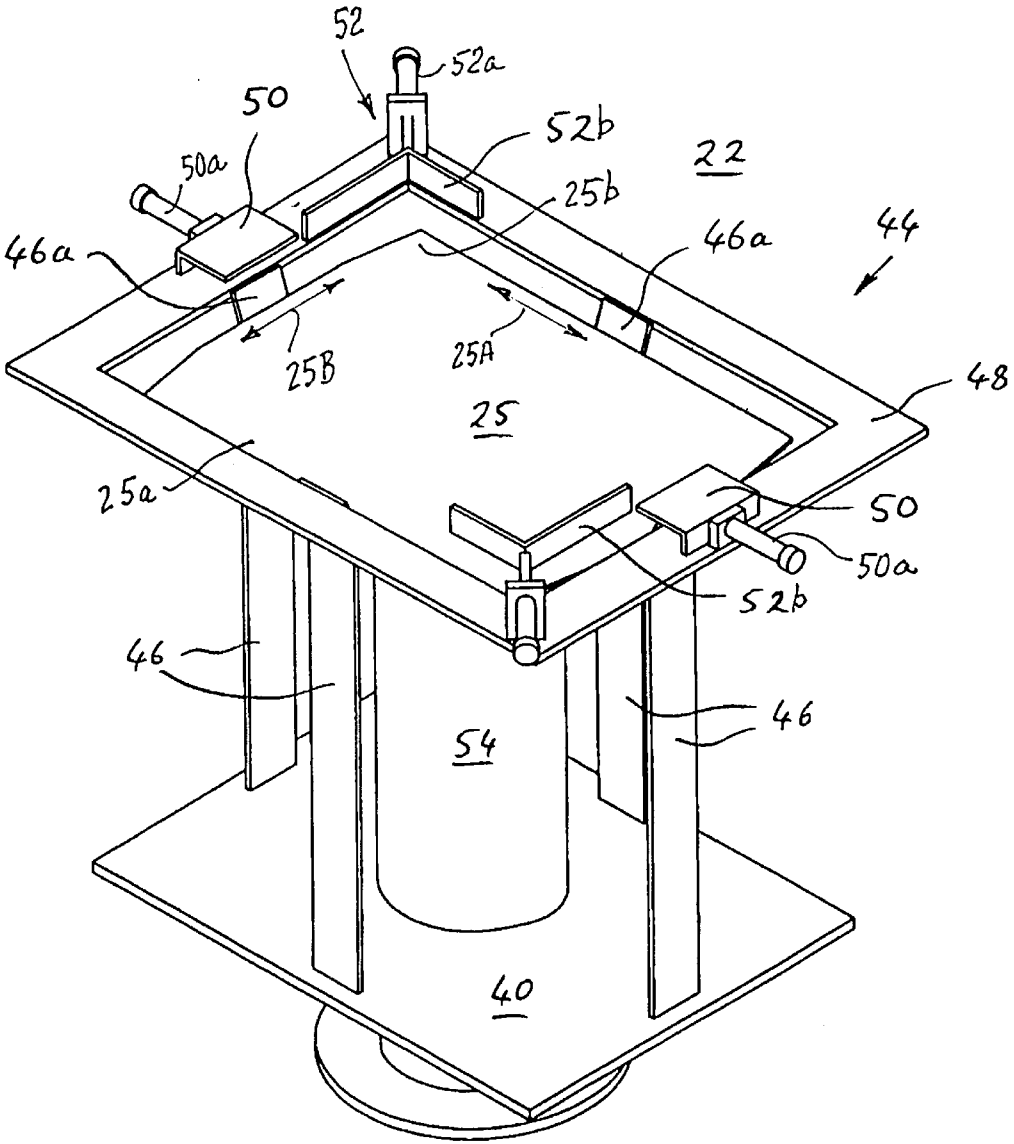
FIG. 7 shows the structure of FIG. 6 but with the blank shown in a chute on top of a raised platform of the orientation ascertaining and correcting means.

The platform 42 is mounted on top of a hydraulic or pneumatic elevator 54 which can move the platform between its uppermost and lowermost positions. The platform 42 is moved to its uppermost position at a level at least close to that of the frame 48 when the conveyor 18 deposits a first blank on top of the props 50 but not later than when the props 50 and the pushers 52 are retracted so that the freshly monitored properly oriented or reoriented blank can descend onto the upper side of the platform 42 through a rather short distance; this reduces the likelihood of misorientation of a monitored blank during descent through the frame 48 and into the upper or uppermost portion of the chute CH. FIG. 7 shows that the upper end portions 46*a* of the upright guide members 46 are bent upwardly and outwardly to thus constitute ramps along which a descending blank 25 can slide to even further "improve", its orientation before it comes to rest Eon the platform 42 or on the partially assembled stack 24 on top of such platform.

It is presently preferred to retract the props 50 from the extended positions of FIG. 6 to the retracted positions of FIG. 7 at least slightly ahead of retraction of the pushers 52. This ensures that the walls 52*b* of the pushers 52 continue to hold a properly oriented blank 25 against any undesirable shifting while the plane surfaces of the props. 50 slide along the underside of such blank. The walls 52*b* can hold a properly oriented blank against movement in the directions indicated by the double-headed arrow 25*a* lengthwise) and/or in directions indicated by the arrow 25B (widthwise or sideways). On the other hand, when the walls 52*b* are to change (correct) the orientation of a mis-oriented blank 25 they can engage the edge faces of the adjacent corners 25*b* to move the blank in the direction of its longitudinal extension (lengthwise as indicated in FIG. 5 by, the arrow 25A) and/or in the direction of its transverse extension. (i.e., widthwise or transversely as indicated by the arrow 25B shown in FIG. 5). It will be seen that the pushers 52 can perform plural functions.

When the retraction of the props 50, preferably followed by retracton of the pushers 52, is completed, the freshly monitored and (if needed) reoriented blank 25 of FIG. 6 is free to descend by gravity and to come to rest upon the platform 42 or upon the topmost blank of the growing stack 24 on the platform (see FIG. 7). The aforementoned suitably sloping upper end portions or ramps 46*a* of the upright guide members 46 enhance the accuracy of re-orientation of a descending blank 25 and/or ensure that the orientation of a properly oriented blank remains unchanged during gravitational descent into and in the chute CH. The topmost parts of the ramps 46*a* extend into the opening which is surrounded by the frame 48. The platform 42 cannot be seen in FIG. 7 because it is maintained in or close to its upper end position (i.e., the elevator 54 is fully or practically fully extended and the blank 25 of FIG. 7 overlies the entire upper side of the platform). The marginal portion 25*a* of the blank which is shown in FIG. 7 is immediately adjacent to or actually contacts the ramps 46*a* and two of the four corners 25*b* of such blank are out of contact with the retracted pushers 52. The preferably flat inner sides of the guide members 46 are in actual contact with or closely adjacent the neighboring parts of the marginal portion 25*a* of the blank 25 on top of the platform 42 when such blank assumes the position of FIG. 7. Thus, the guide members 46 hold each blank 25 in the chute CH against lengthwise and/or against widthwise movement (see the arrows 25A and 25B) from their optimum positions. It will be recalled that the orientation of each and every blank 25 which has entered the chute CH (i.e., which forms part of the stack 24) is assumed to be satisfactory, either because the orientation was satisfactory upon arrival in the median portion 22 of the frame 4 or due to the reorienting action of the pushers 52. In addition to their aforedescribed functions and advantages, the ramps 46*a* ensure a predictable optimum descent of successive blanks 25 into and within the chute CH, i.e., into sliding engagement with the flat inner sides of the upright guide members 46.

It will be appreciated that the blanks 25 need not always have a rectangular, square or another regular outline. The mutual inclinations of the inner sides of the upright guide members 46 are selected in such a way that they can properly (slidably) engage the adjacent parts of the marginal portion 25*a* of each properly oriented blank 25, i.e., of each blank in the chute CH.

Figure 8:
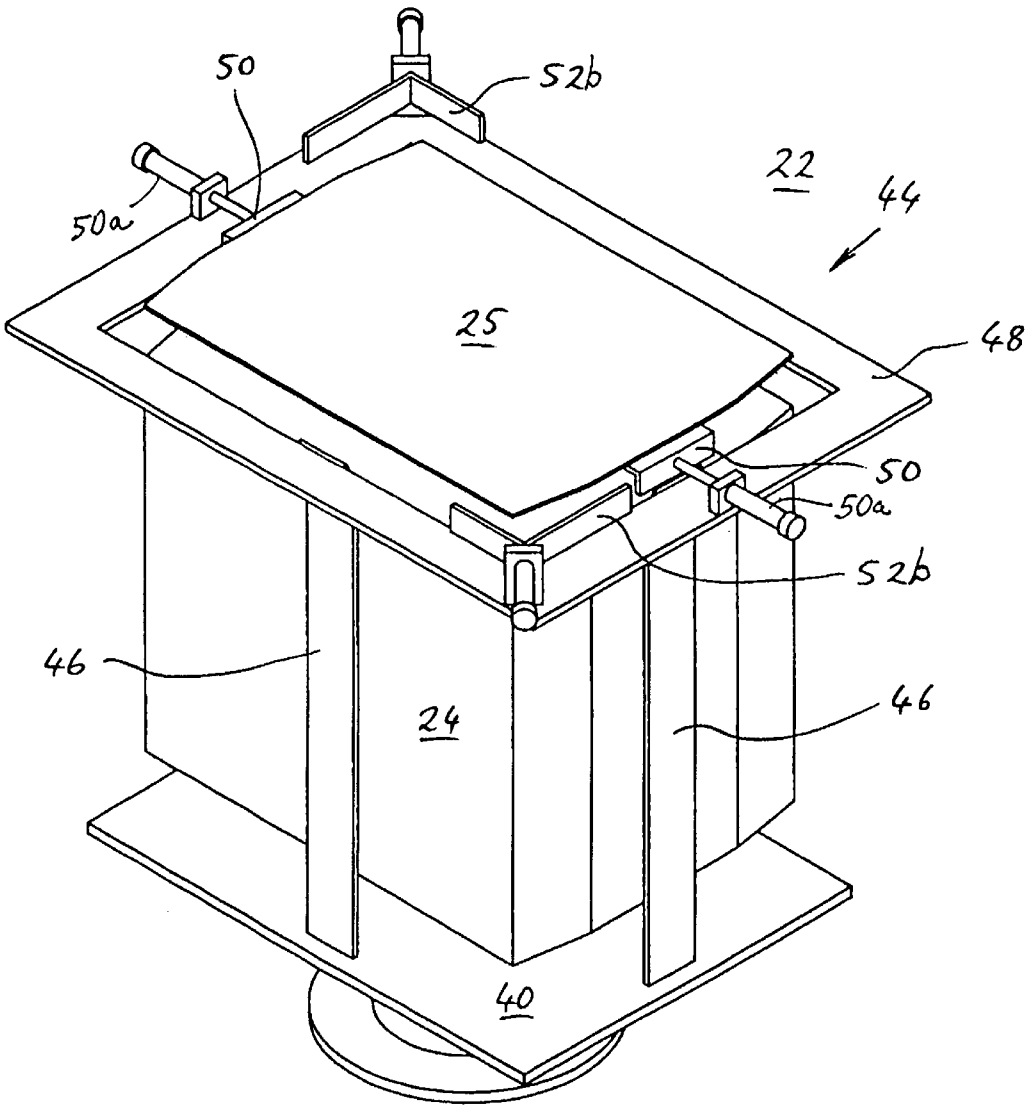
FIG. 8 shows the structure of FIG. 7 but with a full stack of properly oriented (including reoriented) blanks on top of the platform which is maintained in or close to its lowermost position, a freshly supplied blank being supported by the ledges or prongs of the orientation ascertaining and correcting means.
Figure 9:
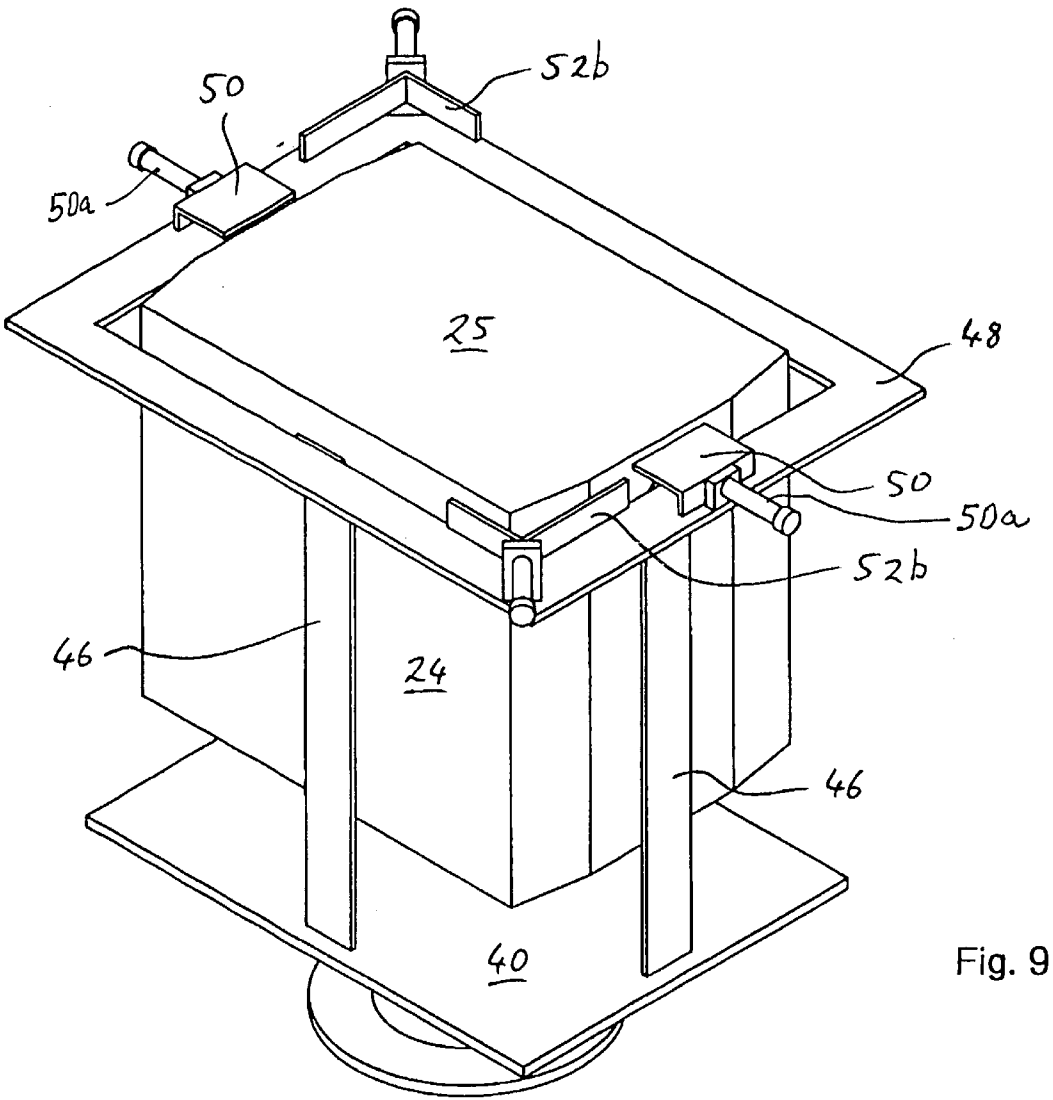
FIG. 9 shows the structure of FIG. 8 but with the freshly supplied blank on top of the stack of properly oriented blanks on the platform of the orientation ascertaining and correcting means.

Once a blank 25 comes to rest on the platform 42 or on the topmost blank of the growing stack 24 borne by the platform 42, the first conveyor 18 is caused to deliver a fresh blank 25 which is thereupon monitored and (if neccessary) reoriented in the above outlined manner. Such blank comes to rest on the plane surfaces of the extended props 50 (see FIG. 8) while the pushers 52 are maintained in their retracted positions. The elevator 54 can be set up to lower the platform 42 by an increment in response to delivery into the chute CH of each and every discrete properly oriented blank 25 or at less frequent intervals. FIG. 8 shows a nearly fully grown stack 24, the same as FIGS. 1 and 2.

When the height of the stack 24 reaches a preselected value, the second conveyor 32 is actuated to transfer successive topmost blanks 25 from the stack 24 onto the block 37 at the station 36. The elevator 54 can simplify such transfer of blanks from the stack 24 into the space between the abutments 62 on the block 37 by repeatedly lifting the platform 42 and the stack 24 thereon so that the topmost blank 25 of the stack 24 is located at or close to a preselected level which is best suited for rapid and predictable transfer of blanks from the intermediate portion 22 of the frame 4 into the station 36. As a rule, it is advisable to repeatedly lift the platform 42 to an extent which is necessary to maintain the topmost blank 25 of the stack 24 at a level close to that of the (then retracted) props 50 (see FIG. 9).

The just described procedure of building up a stack 24 on the platform 42, thereupon transferring the blanks 25 of the stack 24 onto the block 37 at the station 36, again building up a stack 24, transferring the freshly built stack 24 onto the block 37, and so forth constitutes but one mode of advancing blanks 25 from the source S to the packing machine PM. Thus, and as already explained in connection with the description of FIGS. 1 and 2, it is also possible to set up the controls for the motors 16, 20 and 30, 34 in such a way that the first conveyor 18 delivers discrete blanks from the pile 10 or 11 to that intermediate portion of the path between the source S and the packing machine PM which extends through the intermediate portion 22 of the frame 4, that the conveyor 32 thereupon delivers a blank from the stack 24 to the block 37, that the conveyor 18 again delivers a blank from the pile 10 or 11 onto the props 50, and so forth. Thus, if such procedure begins at a time when the platform 42 already supports a stack 24 having a given height, the height of such stack remains unchanged because the rate at which the conveyor 18 delivers blanks onto the props 50 is the same as the rate at which the conveyor 32 delivers blanks to the magazine including the parts 37, 62 at the station 36. Such procedure is desirable on the ground that the conveyor 32 can continue to remove properly oriented blanks 25 from the stack 24 while an empty pallet 8 is being replaced with a pallet supporting two fully grown piles 10, 11 of blanks including properly oriented and/or misoriented blanks. Thus, the stack 24 can constitute a buffer which furnishes properly oriented blanks 25 while the conveyor 18 is idle but the conveyor 32 is in use. The just described procedure ensures that the operation of the packing machine PM need not be interrupted during replenishment of blanks 25 in the source S. The supply of blanks 25 constituting the stack 24 can be replenished while the packing machine PM is idle or is operated at less than normal speed. This involves a change in the synchronization of the controls for the conveyors 18 and 32 by taking into consideration the speed of the packing machine PM, i.e., the rate of processing of blanks 25 which are removed from the pile or stack 38 at the station 36.

The improved method and apparatus exhibit numerous important advantages. Thus, the number of rejects turned out by the packing machine PM can be greatly reduced, even to zero, because each and every blank 25 in the pile or stack 38 has been caused to undergo a monitoring and, if necessary, a change of orientation in the portion of the path leading from the source S to the machine PM which is located ahead of the station 36.

Furthermore, the stack 24 can be used as a buffer to ensure that the packing machine PM need not be arrested or slowed down during replacement of blanks in the source S. This also contributes to a higher output of the packing machine and of the production line which employs the packing machine. The constituents of the orientation monitoring and changing or correcting means in or at the intermediate portion 22 of the frame 4 are simple, compact and inexpensive, and their operations can be synchronized in a surprisingly simple manner.

The compactness of the apparatus can be enhanced in that certain constituents can perform several important and desirable functions. Thus, the pushers 52 can serve as a means for monitoring the orientation of each and every blank 25 and also as a means for correcting the orientation of each blank having an orientation departing from an optimum orientation. Analogously, the guide members 46 and their ramps 46*a* can serve to even more accurately orient successive blanks which are released by the walls 52*a* of the pushers 52 as well as to reliably maintain each blank of the stack 24 in an optimum orientation for direct or stepwise introduction into the packing machine. The platform. 42 can serve as a support for the stack 24 as well as to simplify the task of the second conveyor 32 by maintaining the uppermost blank of the stack 24 at an optimum level for lifting and subsequent sidewise transport toward the station 36.

Still further, the improved method and apparatus can be resorted to for correction of orientation of blanks having different sizes and/or shapes as well as for correction of orientation regardless of the cause or causes of misorientation of some or all of the blanks in the source S. Thus, the apparatus can be utilized to alter (correct) the orientation of each and every blank being withdrawn from the source, to correct the orientation of short or long series of successive misoriented blanks (e.g., those forming the pile 10 or 11), or to correct the orientation of relatively small numbers of individual blanks which are delivered to the source in random distribution with larger numbers of properly oriented blanks.

Without further analysis, the foregoing will so gully reveal the gist of the present invention that others can, by applying current knowledge, readily adapt it for various applications without omitting features that, from the standpoint of prior art, fairly constitute essential characteristics of the generic and specific aspects of the above outlined contribution to the art of manipulating collapsible blanks between a source and a processing machine and, therefore, such adaptations should and are intended to be comprehended within the meaning and range of equivalence of the appended claims.

What is claimed is:

1. Apparatus for supplying blanks from a source to a packing machine in a predetermined orientation, comprising:

means for advancing discrete blanks from the source to the packing machine along a predetermined path; and means for changing the orientation of discrete blanks within said predetermined path when the orientation of blanks in said path departs from said predetermined orientation.

2. The apparatus of claim 1, wherein the blanks are at least substantially collapsed flat bodies of a material which is one of cardboard and a material with a thickness approximating cardboard.

3. The apparatus of claim 1, wherein said advancing means comprises at least one pneumatic conveyor for conveying discrete blanks.

4. The apparatus of claim 1, wherein the blanks are collapsible and said source is arranged to supply collapsed blanks, said packing machine comprising means for expanding the collapsed blanks and for introducing arrays of block-shaped commodities into the expanded blanks.

5. The apparatus of claim 1, wherein said orientation changing means comprises means for manipulating successive blanks of a series of blanks in a plurality of different portions of said path.

6. The apparatus of claim 5, wherein said different portions include at least one at least substantially horizontal and at least one at least substantially vertical portion of said path.

7. The apparatus of claim 1, wherein said advancing means comprises means for temporarily arresting the blanks in a predetermined portion of said path, said orientation changing means being arranged to change the orientation of blanks in said predetermined portion of said path.

8. The apparatus of claim 7, wherein said advancing means further comprises means for stacking arrested blanks in said predetermined portion of said path.

9. The apparatus of claim 7, further comprising means for preventing changes of orientation of blanks between said predetermined portion of said path and the packing machine.

10. The apparatus of claim 1 for supplying blanks of the type having marginal portions, wherein said orientation changing means comprises means for imparting motion at least to the marginal portions of those blanks the orientation of which departs from said predetermined orientation.

11. The apparatus of claim 10, for supplying blanks of the type having longitudinal and transverse extensions, each extending in a direction, wherein said motion imparting means of said orientation changing means includes means for moving blanks having orientations departing from said predetermined orientation in the direction of at least one of said extensions.

12. The apparatus of claim 10, wherein said motion imparting means comprises pushers for pushing marginal portions of the blanks.

13. The apparatus of claim 10, for supplying blanks of the type having marginal portions including corners with mutually inclined edge faces, said motion imparting means including pushers for pushing the edge faces of corners of at least those blanks in a predetermined portion of said path the orientation of which departs from said predetermined orientation.

14. The apparatus of claim 13, wherein said pushers include substantially V-shaped blank-engaging portions.

15. The apparatus of claim 1 for supplying blanks of the type having longitudinal and transverse extensions, wherein said orientation changing means comprises guide means, for shifting misoriented blanks transversely of at least one of said extensions in a predetermined portion of said path.

16. The apparatus of claims 15, further comprising means for temporarily accumulating piles of properly oriented and reoriented blanks in a second portion of said path between said predetermined portion and the packing machine.

17. The apparatus of claim 15 for supplying blanks of the type having mutually inclined marginal portions,. wherein said guide means comprises a plurality of stationary elongated guide members arranged to engage the mutually inclined marginal portions of blanks in said predetermined portion of said path.

18. The apparatus of claim 17 wherein said guide members are at least substantially parallel to each other.

19. The apparatus of claim 17, wherein said guide members include at least substantially vertical portions defining a chute for blanks in said predetermined portion of said path.

20. The apparatus of claim 19, wherein said orientation changing means further comprises a support arranged to intercept successive blanks descending in said chute and to thus accumulate a stack of superimposed blanks having orientations matching said predetermined orientation.

21. The apparatus of claim 20, wherein said orientation changing means further comprises means for moving said support in said chute between an upper level and a lower level.

22. The apparatus of claim 21, wherein said orientation changing means further comprises pushers for pushing marginal portions of blanks in said portion of said path at the upper level.

23. The apparatus of claim 21, wherein said orientation changing means further comprises props arranged to temporarily support, at a level above said chute, successive blanks of a series of blanks being advanced from said source to said predetermined portion of said path.

24. The apparatus of claim 23, wherein said orientation changing means further comprises means for shifting said props between extended positions in which the props intercept and thus prevent gravitational descent of a blank in said chute and retracted positions in which the intercepted blank is free to descend in the chute under the action of gravity until intercepted by said support.

25. The apparatus of claim 24, wherein said props include a pair of ledges confronting each other across said chute and being movable toward each other to said extended positions and away from each other to said retracted positions.

26. Apparatus for supplying blanks in a predetermined orientation, comprising a first station with a source of blanks;

a second station for receiving blanks aligned in the predetermined orientation, means for advancing discrete blanks from the source of blanks at the first station to the second station along a predetermined path; and means for changing the orientation of discrete blanks when the orientation of blanks in said path departs from said predetermined orientation, said changing means being arranged between said first and second stations along said predetermined path.

27. The apparatus of claim 26, wherein the second station is a packing machine.

* * * * *